US012612716B1

(12) United States Patent
Liu

(10) Patent No.: US 12,612,716 B1
(45) Date of Patent: Apr. 28, 2026

(54) WAFFLE WEAVE FLOOR MAT

(71) Applicant: Guangzhou Junkaishang Brand Management Co., Ltd., Guangzhou City (CN)

(72) Inventor: Pei Liu, Guangzhou City (CN)

(73) Assignee: Guangzhou Junkaishang Brand Management Co., Ltd., Guangzhou City (CN)

( * ) Notice: Subject to any disclaimer, the term of this patent is extended or adjusted under 35 U.S.C. 154(b) by 0 days.

(21) Appl. No.: 19/401,517

(22) Filed: Nov. 26, 2025

(30) Foreign Application Priority Data

Aug. 29, 2025 (CN) ..... 202521869588.4

(51) Int. Cl.

| | |
|---|---|
| ***D03D 15/43*** | (2021.01) |
| ***D03D 13/00*** | (2006.01) |
| ***D03D 15/283*** | (2021.01) |
| ***D03D 15/40*** | (2021.01) |
| ***D03D 15/44*** | (2021.01) |

(52) U.S. Cl.
CPC ..... *D03D 13/004* (2013.01); *D03D 15/283* (2021.01); *D03D 15/43* (2021.01); *D03D 15/44* (2021.01); *D03D 15/497* (2021.01); *D10B 2331/04* (2013.01); *D10B 2503/04* (2013.01)

(58) Field of Classification Search
CPC .. D03D 13/004; D03D 15/283; D03D 15/497; D03D 15/44; D03D 15/43; D10B 2331/04; D10B 2503/04
See application file for complete search history.

(56) References Cited

U.S. PATENT DOCUMENTS

| | | | | |
|---|---|---|---|---|
| 2,635,648 | A | 4/1953 | Foster | |
| 11,441,246 | B2 | 9/2022 | Hozumi | |
| 2012/0208416 | A1* | 8/2012 | Lerman | A47G 27/0225 442/1 |

(Continued)

FOREIGN PATENT DOCUMENTS

| | | | | |
|---|---|---|---|---|
| CN | 120158860 | A * | 6/2025 | D06M 13/144 |
| JP | 2025159622 | A * | 10/2025 | |
| WO | WO-2025195489 | A1 * | 9/2025 | D03D 15/56 |

OTHER PUBLICATIONS

English translation of JP-2025159622-A to Asami Suguru obtained from PE2E database (Year: 2025).*

(Continued)

*Primary Examiner* — Jeremy R Pierce
(74) *Attorney, Agent, or Firm* — Cooper Legal Group, LLC

(57) ABSTRACT

A waffle weave floor mat, including a mat body formed by interweaving knitted warp yarns and knitted weft yarns. Both the top surface and the bottom surface of the mat body are divided into grids. Each grid has a resilient concave portion gradually recessing towards the center, and a supporting convex portion is formed between every two resilient concave portions. The knitted warp yarns include bottom warp yarns on the bottom surface of the mat body and main body warp yarns in other positions. The knitted weft yarns include bottom weft yarns on the bottom surface of the mat body and main body weft yarns in other positions. The bottom warp and/or weft yarns are made of long fibers, while the main body warp and weft yarns include short fibers. The bottom warp and weft yarns are coated with an anti-slip coating on a side away from the top surface.

16 Claims, 6 Drawing Sheets

(56) References Cited

U.S. PATENT DOCUMENTS

| | | | | |
|---|---|---|---|---|
| 2019/0309173 | A1* | 10/2019 | Lu | D06M 15/333 |
| 2019/0309448 | A1* | 10/2019 | Holbert, Jr. | D01D 5/30 |
| 2025/0146195 | A1* | 5/2025 | Hu | D04B 21/08 |
| 2026/0034774 | A1* | 2/2026 | Wu | B32B 27/12 |

OTHER PUBLICATIONS

English translation of WO-2025195489-A1 to Chen et al. obtained from PE2E database (Year: 2025).*
English translation of CN-120158860-A to Huang et al. obtained from PE2E database (Year: 2025).*

* cited by examiner

WAFFLE WEAVE FLOOR MAT

CROSS-REFERENCE TO RELATED APPLICATIONS

The present application claims priority of Chinese Patent Application No. 202521869588.4, filed on Aug. 29, 2025, in the China National Intellectual Property Administration, the entire contents of which are hereby incorporated by reference in its entirety.

TECHNICAL FIELD

The present disclosure relates to the technical field of floor mats, and in particular, to a waffle weave floor mat.

BACKGROUND

The waffle weave floor mat is increasingly favored by users for the unique waffle-patterned texture on its surface, which provides comfortable underfoot feel. Currently, common waffle weave floor mats on the market typically use staple fiber yarn as the weaving material and have an anti-slip coating applied to the bottom layer, relying on the adhesion between this coating and the floor to achieve anti-slip functionality.

However, when this common waffle weave floor mat is placed in a washing machine for cleaning, the mechanical actions such as water impact and friction inside the machine, combined with the fact that the staple fiber yarn is composed of relatively short fibers with limited cohesion between them, result in a relatively weak coating adhesion capability. Consequently, after multiple washes, the anti-slip coating is prone to detach from the mat.

Once the anti-slip coating falls off, the anti-slip performance of the mat's bottom layer decreases significantly. This not only affects the mat's normal functionality but also poses a serious safety hazard to users, particularly in wet and slippery environments like bathrooms, increasing the risk of slips and falls.

To address this issue, although attempts have been made within the industry to improve the performance of the anti-slip coating or optimize the coating process, there is currently no truly effective method that fundamentally solves the problem of coating detachment in staple-fiber waffle weave floor mats after washing. Therefore, developing a waffle weave floor mat that maintains good anti-slip performance after cleaning has significant practical importance and market demand.

The above content is intended only to assist in understanding the technical solution of the present disclosure and does not constitute an admission that such content is prior art.

SUMMARY OF THE DISCLOSURE

The present disclosure provides a waffle weave floor mat, including a mat body; wherein the mat body is formed by interweaving a plurality of knitted warp yarns and a plurality of knitted weft yarns lengthwise and crosswise; each of a top surface and a bottom surface of the mat body is divided into a plurality of grids; each grid includes a resilient concave portion gradually recessed from an edge towards a center, and a supporting convex portion is formed between each adjacent two resilient concave portions;

the knitted warp yarns include bottom warp yarns located on the bottom surface of the mat body and main body warp yarns located in other positions; the knitted weft yarns include bottom weft yarns located on the bottom surface of the mat body and main body weft yarns located in other positions;

at least one kind of the bottom warp yarns and the bottom weft yarns is filament yarns; the main body warp yarns and the main body weft yarns are staple fiber yarns; and the bottom warp yarns and the bottom weft yarns are at least coated with an anti-slip coating on a side away from the top surface of the mat body.

BRIEF DESCRIPTION OF THE DRAWINGS

To provide a clearer explanation of the technical solutions in the embodiments of the present disclosure, the following will briefly describe the drawings required for describing the embodiments. Obviously, the drawings in the following description are only some embodiments of the present disclosure. For those skilled in the art, other drawings may be obtained based on these drawings without creative effort.

Figure 1:
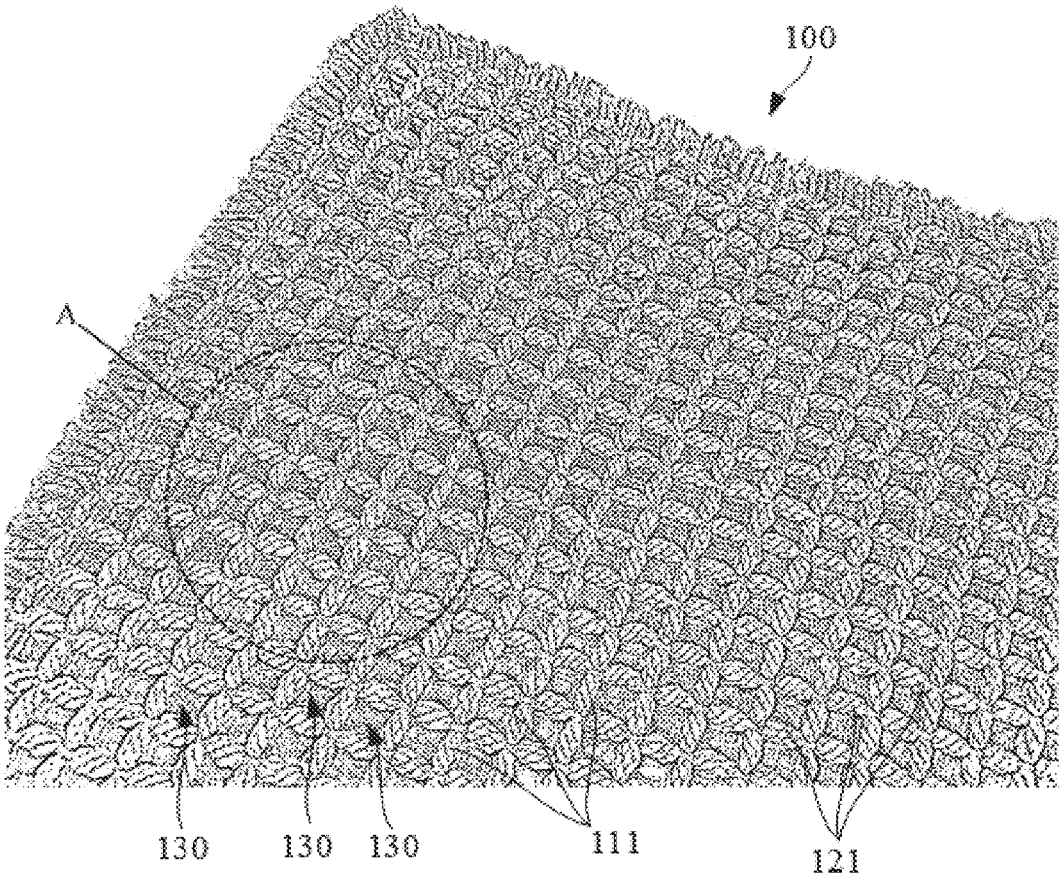
FIG. 1 is a schematic structural diagram of a waffle weave floor mat according to some embodiments of the present disclosure.

The realization of the objectives, functional features, and advantages of the present disclosure will be further explained in combination with the embodiments and with reference to the drawings.

DETAILED DESCRIPTION

The following clearly and completely describes the technical solutions in the embodiments of the present disclosure with reference to the accompanying drawings. Obviously, the described embodiments are only a part of the embodiments of the present disclosure, not all of them. All other embodiments obtained by those skilled in the art based on the embodiments of the present disclosure without creative effort shall fall within the scope of the present disclosure. Furthermore, technical solutions between various embodiments may be combined with each other, but this must be based on the ability of those skilled in the art to implement such combination. If the combination of technical solutions leads to mutual contradiction or impossibility of implementation, it shall be considered that such a combination does not exist and is not within the claimed protection scope of the present disclosure.

It should be noted that when there are directional indications (such as up, down, left, right, front, back . . . ) involved in the embodiments of the present disclosure, these directional indications are only intended to explain the relative positional relationships, movement, etc., of various components in a specific posture. When the specific posture changes, the directional indications shall change accordingly.

In the embodiments of the present disclosure, unless otherwise clearly specified and defined, a first feature being "on" or "under" a second feature may indicate that the first and second features are in direct contact, or that they are in indirect contact through an intermediate medium. Furthermore, the first feature being "above", "over", or "on top of" the second feature may mean that the first feature is directly above or obliquely above the second feature, or merely indicates that the horizontal height of the first feature is greater than that of the second feature. The first feature being "under", "below", or "beneath" the second feature may mean that the first feature is directly below or obliquely below the second feature, or merely indicates that the horizontal height of the first feature is less than that of the second feature.

In the embodiments of the present disclosure, unless otherwise clearly specified and defined, the terms "mount", "connect", "link", "fix", etc., shall be understood broadly. For example, it may be a fixed connection, a detachable connection, or an integral connection; it may be a mechanical connection, an electrical connection, or communication with each other; it may be a direct connection, an indirect connection through an intermediate medium, or an internal connection between two elements or an interaction relationship between two elements. Unless otherwise clearly defined, for those skilled in the art, the specific meanings of the above terms in the present disclosure may be understood according to the specific context.

Furthermore, when the descriptions in the embodiments of the present disclosure involve "first", "second", etc., these descriptions are for descriptive purposes only and cannot be understood as indicating or implying relative importance or implicitly indicating the quantity of the indicated technical features. Thus, features defined with "first" and "second" may explicitly or implicitly include at least one such feature. Also, the meaning of "and/or" appearing in the full text includes three parallel options. Taking "A and/or B" as an example, it includes solution A, or solution B, or the solution where both A and B are satisfied.

To address the technical problem of the anti-slip coating easily falling off the waffle weave floor mat after cleaning, the inventor discovered during research and development that the core reason for coating detachment lies in the characteristics of the yarn structure. Staple fiber yarn (short fiber yarn) has a fuzzy surface with numerous loose fibers that are prone to shedding after multiple washes, which leads to the detachment of the anti-slip coating adhered to this fuzz. By adopting a material substitution approach, the yarn for the bottom load-bearing layer is replaced with continuous filament yarn (long fiber yarn), utilizing its smooth surface and tight structure to enhance the adhesion of the coating. Meanwhile, the staple fiber yarn in the main body part is retained to maintain the mat's original soft texture, forming a composite structural design solution.

Based on this, the present disclosure proposes a waffle weave floor mat. This mat features a grid design similar to a waffle, creating a three-dimensional grid-like texture of concave-convex patterns, akin to a honeycomb structure, which may significantly increase the surface area of the mat, thereby enhancing its water absorption and breathability.

In some embodiments of the present disclosure, referring to FIG. 1 to FIG. 4, the waffle weave floor mat includes a mat body 100, formed by interweaving multiple knitted warp yarns 110 and multiple knitted weft yarns 120 lengthwise and crosswise. Each of a top surface and a bottom surface of the mat body 100 is divided into multiple grids 130. Each grid 130 includes a resilient concave portion 131 that gradually recesses from an edge towards a center. A supporting convex portion 132 is formed between each adjacent two resilient concave portions 131. The knitted warp yarns 110 include bottom warp yarns 111 located on the bottom surface of the mat body 100 and main body warp yarns 112 located in other positions. The knitted weft yarns 120 include bottom weft yarns 121 located on the bottom surface of the mat body 100 and main body weft yarns 122 located in other positions. The bottom warp yarns 111 and/or the bottom weft yarns 121 are filament yarns, while the main body warp yarns 112 and main body weft yarns 122 are staple fiber yarns. The bottom warp yarns 111 and the bottom weft yarns 121 are coated with an anti-slip coating at least on a side facing away from the top surface of the mat body 100.

In this implementation, the mat body 100 formed by interlacing knitted warp and weft yarns may be softer, fluffier, offers better resilience, and have good moisture absorption and breathability. A double-sided weaving process may be adopted, causing both the top and bottom surfaces of the mat body 100 to form a woven structure with multiple grids 130. Each grid 130, having a resilient concave portion 131 that gradually recesses from the edge towards the center, forms a structure similar to an inverted pyramid. The resilient concave portion 131 refers to a three-dimensional concave structure formed by differences in the float lengths of the warp and weft yarns, specifically achievable by adjusting the loom's dobby sequence to shorten the float length in the central area and gradually increase the float length towards the edge.

Because the top and bottom surfaces of the waffle weave floor mat are divided into multiple grids 130, each with a resilient concave portion 131 recessing from the edge to the center, and a supporting convex portion 132 between adjacent concave portions, the top and bottom surfaces of the mat include these supporting convex portions 132. Therefore, when a foot steps on the mat, it only contacts the supporting convex portions 132. The moisture absorbed by the supporting convex portions 132 is partially evaporated and quickly transferred to the resilient concave portions 131. Thus, the supporting convex portions on the top surface of the mat remain dry, enabling the entire mat to possess both strong water absorption and quick-drying properties.

The anti-slip coating may be essentially a polymer coating covering the surface of the bottom yarns, which may be achieved using thermoplastic polyurethane or rubber-based adhesive applied through processes like dipping or brushing to form a continuous layer. The bottom warp yarns and the bottom weft yarns are coated with the anti-slip coating at least on the bottom side that contacts the ground. To increase the coating coverage, in some embodiments, the surfaces of both the bottom warp yarns 111 and the bottom weft yarns 121 are coated with an anti-slip coating layer. It should be noted that long fibers refer to fibers with very long, theoretically infinite length (generally over 1 meter, can form continuous filaments), such as silk, rayon, polyester filament, nylon filament, etc. The filament yarn is made from one or multiple continuous long fibers with lengths up to kilometers, having no interruptions. Filament yarn may specifically be made from synthetic fibers like nylon or polyester. The surface of filament yarn is smooth and free of hairiness, resisting pilling. In contrast, short fibers refer to fibers with relatively short, finite lengths, generally ranging from a few millimeters to tens of centimeters, such as cotton fibers, wool fibers, and chemical short fibers. The staple fiber yarn is made from short fibers (millimeters to tens of millimeters in length) processed through spinning. Staple fiber yarn has a fuzzy surface, imparting a downy feel, but the fibers are discrete with low inter-fiber friction, resulting in weak fiber cohesion and susceptibility to breakage.

Therefore, when anti-slip coating is applied to both filament and staple fiber yarns, and the mat is washed multiple times in a washing machine, the mechanical actions like water impact and friction inside the machine may cause the coating to detach due to the shedding of yarn fuzzes. This leads to the loss of the anti-slip coating applied to the staple fiber yarn along with its fuzz. The smooth surface characteristic of filament yarn enables the anti-slip coating to fully penetrate the gaps between yarns and form a mechanical interlock. After the coating cures, it forms a strong bond with the filament yarn. Therefore, after multiple washes, the bonding force between the anti-slip coating on the filament yarn and the yarn itself shows no significant change, and the filament yarn itself does not shed after repeated cleaning. Consequently, the debonding rate of the coating from staple fiber yarn is significantly higher than from filament yarn.

To prevent snagging and ensure the softness and cushioning properties of the mat, current waffle weave floor mats are predominantly woven from staple fiber yarn. Therefore, the bottom layer of existing mats is made from staple fiber yarn, leading to insufficient coating adhesion. The proposed solution of the present disclosure may address this by replacing the yarn in the bottom layer of the mat with filament yarn, specifically enhancing the strength of the coating interface while maintaining the comfort of the main structure. The high strength of filament yarn may further improve the wear resistance of the bottom woven layer, creating a dual protective mechanism.

The present disclosure proposes that the bottom warp yarns 111 and/or the bottom weft yarns 121 of the bottom layer of the waffle weave floor mat use filament yarn, and are coated with anti-slip coating, while the rest of the mat uses staple fiber yarn. This approach may ensure the overall fluffiness, softness, good resilience, and snag resistance of the mat. In addition, after the anti-slip coating cures, it bonds firmly with the filament yarn at the bottom, forming a continuous and dense coating on the surface of the bottom yarns. Compared to using staple fiber yarn for the bottom, the proposed design of the present disclosure may effectively prevent the coating from peeling due to shedding of yarn fuzzes during cleaning, significantly enhance the overall coating adhesion of the mat, and reduce the debonding rate after multiple washes, thereby greatly improving the long-term anti-slip performance of the mat, avoiding safety hazards caused by coating detachment, and extending the product's service life.

Figure 2:
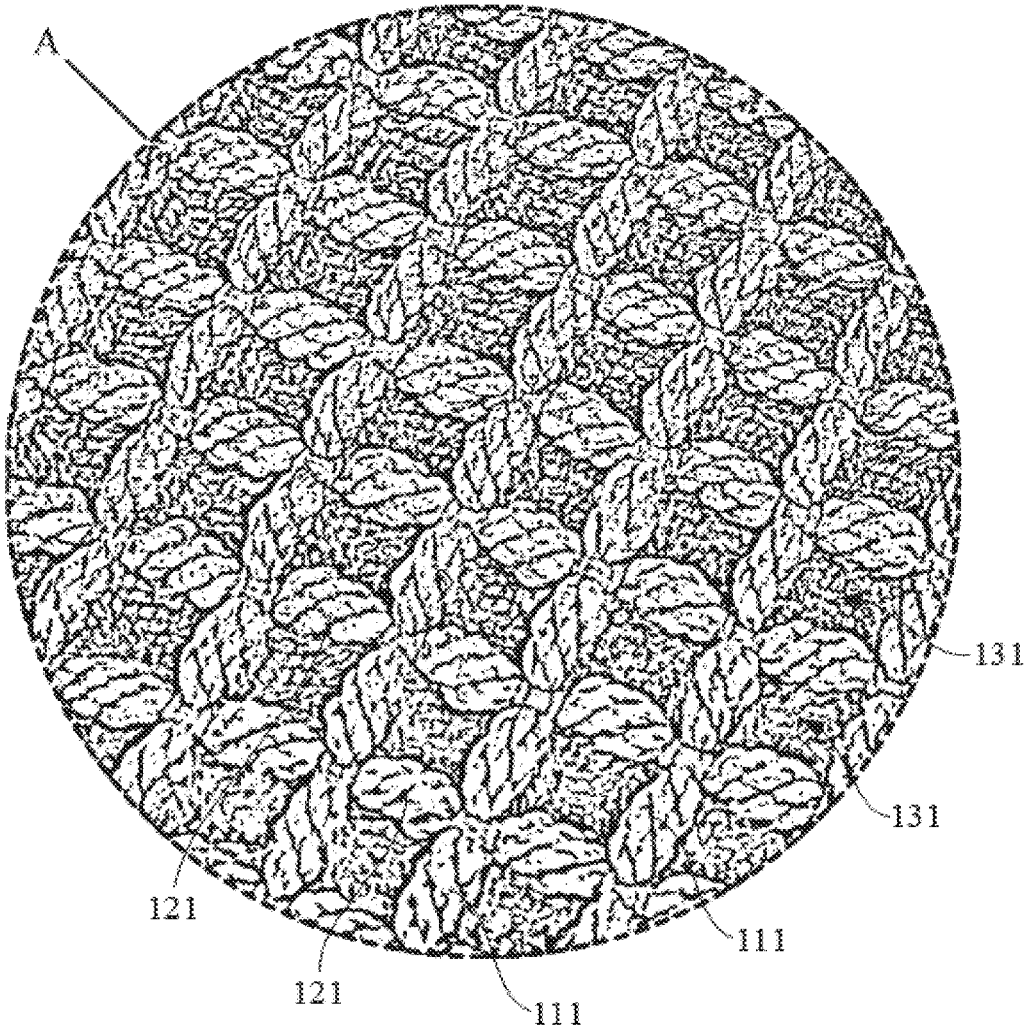
FIG. 2 is a partial enlarged view of area A circumscribed in FIG. 1.
Figure 3:
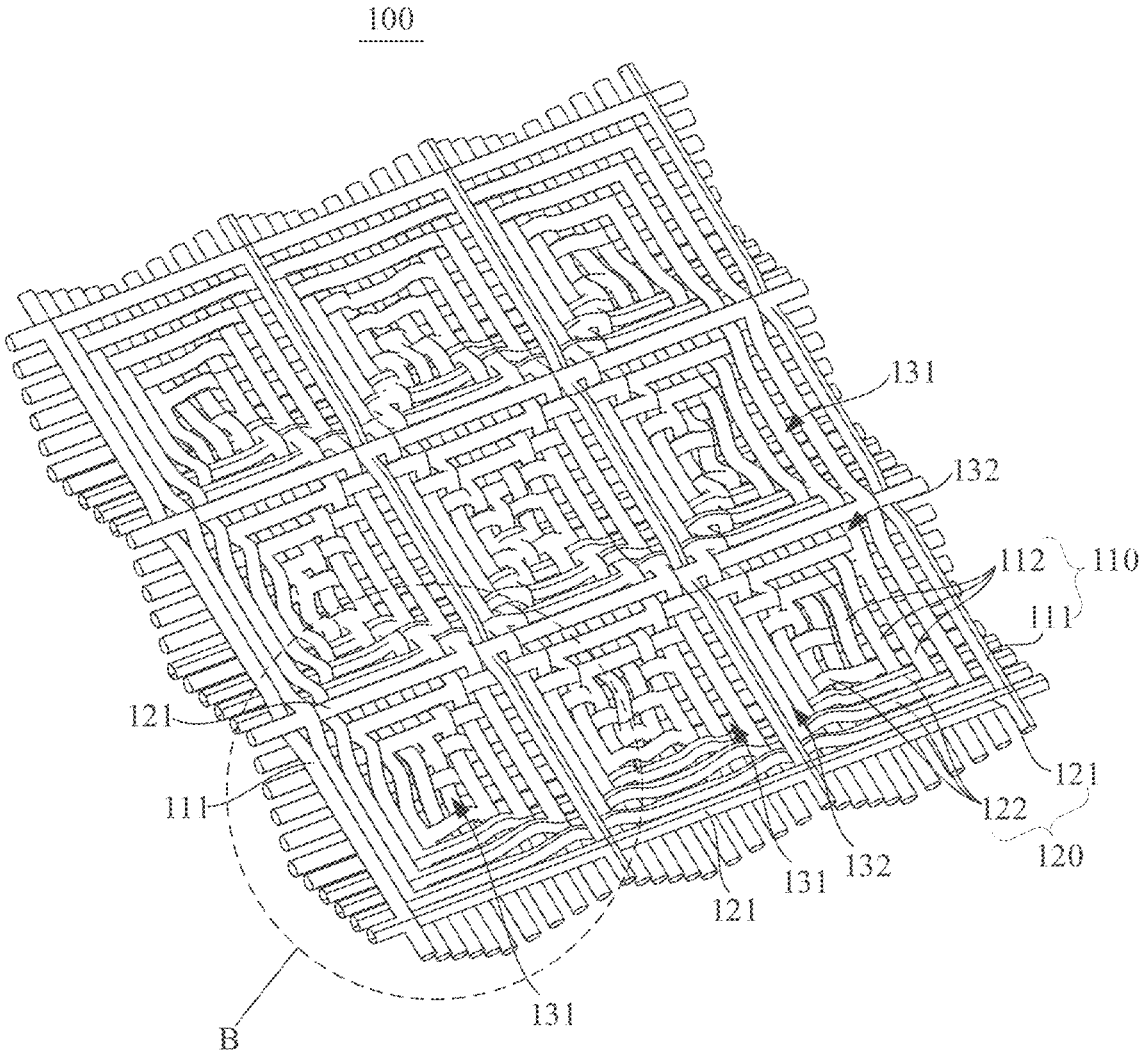
FIG. 3 is a schematic bottom view of a waffle weave floor mat according to other embodiments of the present disclosure.
Figure 4:
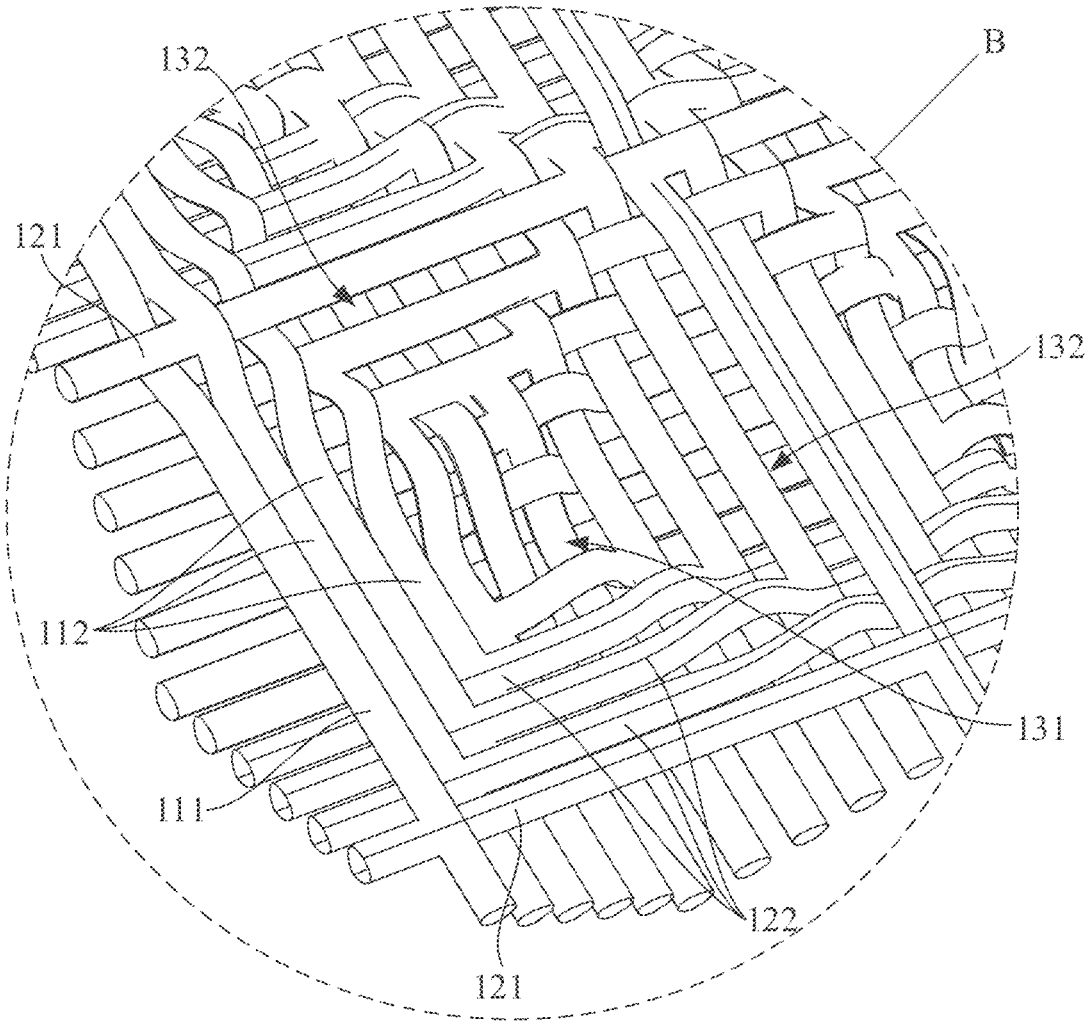
FIG. 4 is a partial enlarged view of area B circumscribed in FIG. 3.
Figure 5:
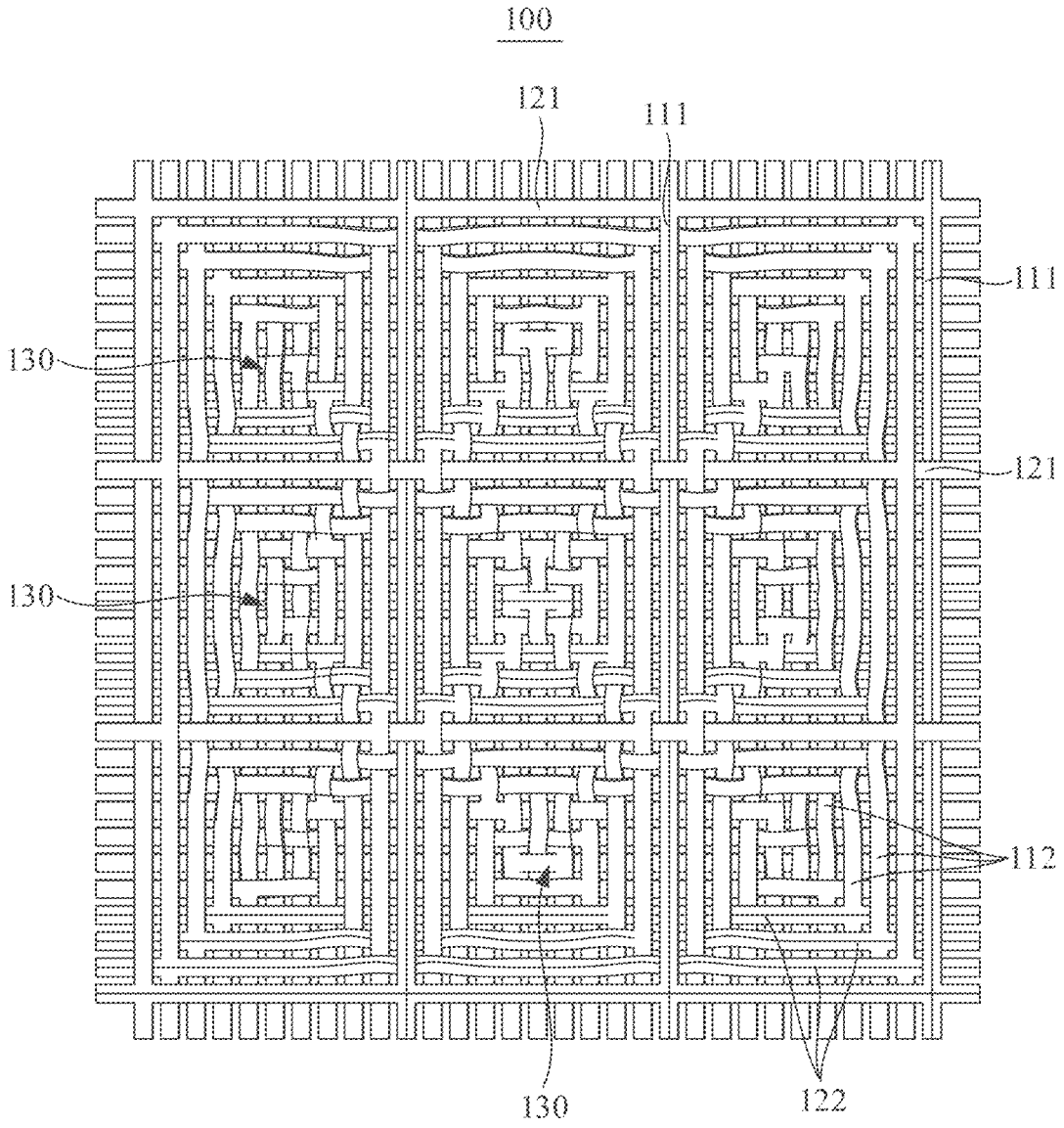
FIG. 5 is a front view of the waffle weave floor mat of FIG. 3.
Figure 6:
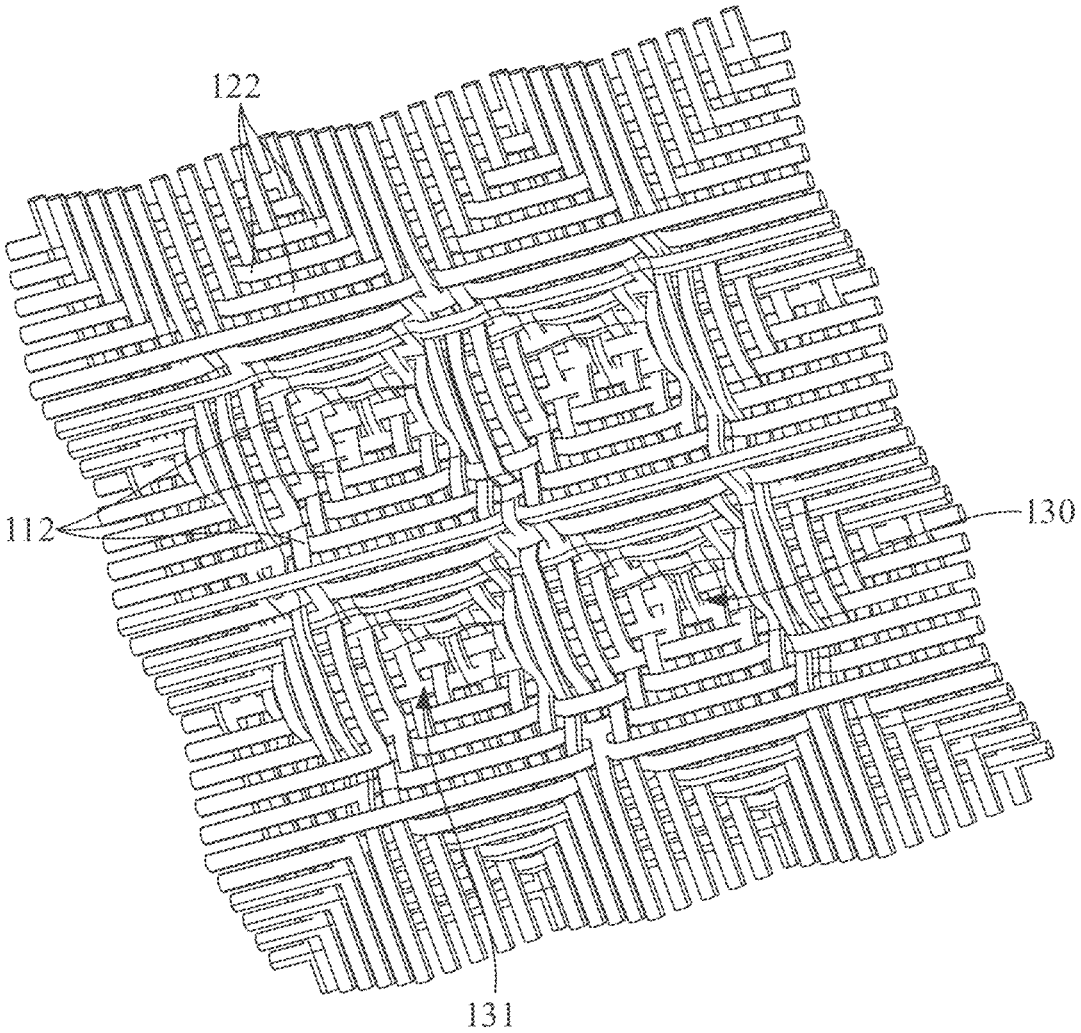
FIG. 6 is a top view of the waffle weave floor mat of FIG. 3.

In some embodiments, as shown in FIGS. 1 and 2, both the bottom warp yarns 111 and the bottom weft yarns 121 are made from long fibers, and a diameter of each bottom warp yarn 111 is greater than a diameter of each main body warp yarn 112, while a diameter of each bottom weft yarn 121 is greater than a diameter of each main body weft yarn 122.

In the embodiments, configuring both the bottom warp yarns 111 and the bottom weft yarns 121 as filament yarns ensures that the bottommost layer of the floor mat consists entirely of filament yarn, effectively enhancing the mat's overall resistance to delamination. The statement that the diameter of the bottom warp yarn 111 is greater than the diameter of the main body warp yarn 112 refers to the cross-sectional size of the bottom warp yarn 111 being larger than that of the main body warp yarn 112. Similarly, the diameter of the bottom weft yarn 121 being greater than the diameter of the main body weft yarn 122 means the cross-sectional size of the bottom weft yarn 121 is larger than that of the main body weft yarn 122. This may be achieved, for instance, by increasing the number of fibers in a single bottom yarn or by employing a twisting process.

Using yarns with a smaller diameter for the main body warp yarns 112 and main body weft yarns 122 ensures the tightness and firmness of the weave in the main body of the mat. By making the diameter of the bottom warp yarns 111 greater than that of the main body warp yarns 112, and the diameter of the bottom weft yarns 121 greater than that of the main body weft yarns 122, the contact area between the bottom yarns and the anti-slip coating is increased. Building upon the use of filament yarn for both the bottom warp and weft yarns, this may enable the bottom of the mat to form a more stable coating substrate, reducing the risk of the anti-slip coating peeling off during the cleaning process. In other words, the larger diameter of the bottom yarns, combined with their filament characteristics, helps resist the shearing effect of water impact on the coating layer, thereby maintaining the anti-slip performance of the mat's bottom surface.

Furthermore, the ratio of the diameter of the bottom warp yarn 111 to the diameter of the main body warp yarn 112 may be greater than 2, and/or the ratio of the diameter of the bottom weft yarn 121 to the diameter of the main body weft yarn 122 may be greater than 2. This further increases the contact area between the bottom yarns and the anti-slip coating, enhancing the adhesion of the coating to the bottom yarns and the bond strength between the bottom yarns and the coating layer, enabling the coating to remain intact even after multiple washes, thereby further reducing the mat's debonding rate.

In some embodiments, the bottom warp yarns 111 are formed by plying at least two strands of yarn, and the bottom weft yarns 121 are formed by plying at least two strands of yarn. Here, the bottom warp yarns 111 and bottom weft yarns 121 are composite yarns formed by twisting two or more single yarns with a low twist, creating a larger diameter composite yarn. During weaving, the interweaving points formed by these composite bottom yarns have a lower density compared to areas with staple fiber yarn, enabling the anti-slip coating to fully penetrate the gaps between the plies of the bottom yarns and encapsulate the yarn surface, thereby further enhancing the bond between the bottom yarns and the anti-slip coating.

Further, as shown in FIGS. 1 and 2, a diameter of each single yarn strand constituting the bottom warp yarn 111 is greater than or equal to the diameter of the main body warp yarn 112, and a diameter of each single yarn strand constituting the bottom weft yarn 121 is greater than or equal to the diameter of the main body weft yarn 122. Since the bottom warp and weft yarns are composite yarns, ensuring that the diameter of each single strand is greater than or equal to that of the main body yarns may significantly increase the contact area between the cured coating and the yarn, thereby further prolonging the durability of the mat's anti-slip performance.

In some embodiments, a twist level of the at least two plied strands of the bottom warp yarn 111 is less than a twist level of the main body warp yarn 112.

The twist level refers to the number of twists per unit length in the twisting process, indicating the tightness of the spiral arrangement of fibers or plies within the yarn. A lower twist makes the structure of the bottom warp yarns 111 looser, increasing the gaps between fibers, thereby enlarging the contact area with the anti-slip coating. The main body warp and weft yarns have a higher twist to ensure the tightness and wear resistance of the main mat structure, while the multiple strands of the bottom warp yarns 111 are designed with a low twist. During the coating process, the anti-slip coating can penetrate into the gaps between the fibers inside the yarn, forming a three-dimensional bond between the coating layer and the yarn. Because low-twist yarn has a larger surface area and porosity, the coating penetrates deeper, enhancing the bond strength between the coating layer and the bottom warp yarns 111. This may ensure the coating remains stably attached and resistant to peeling from the yarn under mechanical impact, thereby maintaining the mat's long-term anti-slip performance.

Furthermore, a twist level of each single yarn strand constituting the bottom warp yarn 111 may be less than the twist level of the main body warp yarns 112. The main body warp and weft yarns maintain a higher degree of twist to preserve the stability of the woven structure. In contrast, each single strand of the bottom warp yarns 111, by reducing the number of twists, creates a loose fiber surface. During the coating process, this loose fiber surface forms more micro-porous structures, enabling the anti-slip coating to penetrate the fiber gaps and create a mechanical anchor, thereby increasing the adhesive contact area of the bottom warp yarns 111 and further enhancing the bond strength between the anti-slip coating and the bottom yarns.

In some embodiments, the twist level of the at least two plied strands of the bottom weft yarn 121 is less than the twist level of the main body weft yarn 122.

The main body warp and weft yarns have a higher twist to ensure the tightness and wear resistance of the main mat structure. A lower twist makes the structure of the bottom weft yarns 121 looser, increasing the gaps between fibers, thus enlarging the contact area with the anti-slip coating. The multiple strands of the bottom weft yarns are designed with a low twist. During coating, the anti-slip coating can penetrate the internal fiber gaps of the yarn, forming a three-dimensional bond with the yarn. The larger surface area and porosity of the low-twist yarn allow for deeper coating penetration, enhancing the bond strength between the coating layer and the bottom yarns. This may ensure the coating remains stable and adherent under mechanical impact, thereby preventing peeling and maintaining long-term anti-slip performance.

In some embodiments, a twist level of each single yarn strand constituting the bottom weft yarn 121 is less than the twist level of the main body weft yarns 122. The main body warp and weft yarns maintain a higher twist for structural stability. Each single strand of the bottom weft yarns 121, with reduced twist, forms a loose fiber surface. During coating, this creates micro-pores for the coating to penetrate and mechanically anchor, increasing the adhesive contact area of the bottom weft yarns 121 and strengthening the bond between the coating and the bottom yarns.

In some embodiments, the twist level of the at least two strands of the bottom warp yarn 111 is less than the twist level of the main body warp yarn 112, and the twist level of the at least two strands of the bottom weft yarn 121 is less than the twist level of the main body weft yarn 122.

The main body warp yarns 112 and the main body weft yarns 122 have a relatively high twist level, which ensures the compactness and wear resistance of the main structure of the floor mat. A lower twist level makes the structure of the bottom yarns looser and increases the gaps between fibers, thereby enlarging the contact area with the anti-slip coating. The multiple strands of the bottom warp yarns 111 and the bottom weft yarns 121 are designed with a low twist level. During the coating process, the anti-slip coating can penetrate into the gaps between the fibers inside the yarn, enabling the anti-slip coating layer to form a three-dimensional bond with the yarn. Due to the larger surface area and higher porosity of low-twist yarns, the penetration depth of the adhesive increases. This may enhance the bonding strength between the anti-slip coating layer and the bottom warp yarns 111 and bottom weft yarns 121. Consequently, the coating layer remains stably attached and is less prone to peeling from the yarn under mechanical impact, thereby maintaining the long-term anti-slip performance of the floor mat.

Furthermore, the twist level of each strand of the bottom warp yarn 111 is lower than the twist level of the main body warp yarn 112, and the twist level of each strand of the bottom weft yarn 121 is lower than the twist level of the main body weft yarn 122. The main body warp yarns 112 and main body weft yarns 122 maintain a high degree of twisting to ensure the stability of the woven structure. In contrast, by reducing the number of twists, each strand of the bottom weft yarns 121 and bottom warp yarns 111 forms a loose fiber surface. During the coating process, this loose fiber surface creates more micro-porous structures, allowing the anti-slip coating to penetrate the fiber gaps and form a mechanical anchor. This may increase the adhesive contact area of the bottom weft yarns 121 and bottom warp yarns 111, thereby further enhancing the bonding strength between the anti-slip coating and the bottom yarns.

In some embodiments, referring to FIGS. 3 to 6, both the warp float length and the weft float length of the mat body 100 transition gradually from short to long from a center bottom of the resilient concave portion 131 towards peripheral edges, such that the warp and weft float lengths on the top and bottom surfaces of the mat body 100 are greater than those in other areas.

The warp float length refers to the continuous length of warp yarn floating on the fabric surface, and the weft float length refers to the continuous length of weft yarn floating on the fabric surface. The gradual transition of these float lengths creates a pyramid-like groove structure extending from the center to the edges. The short float interlocking structure may enhance overall elasticity and improve the mechanical support relationship between the resilient concave portions 131 and the supporting convex portions 132. The longer float structure on the bottom surface may increase the contact area between the yarn and the anti-slip coating, while the short float interlocking structure in the middle layer buffers external impacts through elastic deformation, thereby reducing the likelihood of coating detachment during cleaning.

In an example, the material for the bottom warp yarns 111 and bottom weft yarns 121 is filament polyester. Specifically, high-strength filament polyester may be used. Its smooth surface and continuous fiber length provide high tensile strength and abrasion resistance, thereby enhancing the bond between the bottom yarns and the anti-slip coating, thus making the coating on the bottom warp yarns 111 and bottom weft yarns 121 less likely to detach.

In an example, the main body warp yarns 112 and main body weft yarns 122 are both made from a blend of long and short fibers. This blend involves combining continuous filaments with fibers cut into short lengths through twisting or plying. Specifically, a staple fiber blend of shrinkable polyester and acrylic may be used, spun into the main body warp yarns 112 and main body weft yarns 122 using a semi-worsted spinning process. When the main body yarn uses a long and short fiber blend, the long fibers act as a core providing skeletal support and maintaining yarn strength, inhibiting yarn deformation during washing. The short fibers cover the core, adding surface hairiness for softness and preventing snagging. In some embodiments, the length of each of the main body warp yarns 112 and main body weft yarns 122 is 10-20 cm to ensure the mat's fluffiness and softness.

In some embodiments, the bottom warp yarns 111 and the bottom weft yarns 121 are both made of hollow yarn.

In the embodiments, the hollow yarn refers to yarn with a continuous or intermittent hollow structure inside. When the bottom warp yarns 111 and the bottom weft yarns 121 are woven from hollow yarn, the capillary effect of the hollow part enhances coating adsorption, enabling the coating to contact both the inner and outer surfaces of the yarn, thereby improving coverage uniformity. The hollow structure increases the yarn surface area and creates micro-pores or grooves, providing more attachment sites for the coating, thereby forming a mechanical interlock after curing. During cleaning, when water impact acts on the coating, the bond strength between the anti-slip coating and the bottom warp yarns 111 and the bottom weft yarns 121 relies not only on surface adhesion but also on the mechanical anchoring of the coating within the micro-pores, resisting peeling and further improving the coating retention of the bottom yarns, thereby reducing the debonding rate. Additionally, the hollow structure may reduce yarn density, keeping the coated bottom lightweight and buffering water absorption deformation during cleaning, thereby reducing stress concentration in the coating layer.

In some embodiments, a hollow ratio of the hollow yarn is greater than or equal to 15% and less than or equal to 40%. The hollow ratio is the ratio of the cross-sectional area of the hollow part to the total cross-sectional area of the yarn. If the hollow ratio is less than 15%, the hollow effect is weak, and the advantage of improving coating adhesion is insignificant. If the hollow ratio exceeds 40%, it reduces spinning yield and yarn strength. By using hollow yarn for the bottom warp yarns 111 and the bottom weft yarns 121 with a hollow ratio between 15% and 40%, sufficient coating surface is provided by the hollow structure, which may effectively enhance the bond between the coating and the bottom yarns, while avoiding insufficient yarn strength due to an excessively high hollow ratio.

The present disclosure further proposes a manufacturing method for a waffle weave floor mat, where the mat is as described in any of the previous embodiments.

The manufacturing method includes operation of: raw material preparation, warping, reed drawing-in, weaving, finishing, and coating application.

The raw material preparation operation includes:

preparing staple fiber yarns and filament yarns.

The weaving operation includes:

using a rapier loom to form a multi-grid mat body 100 structure based on warp and weft float patterns. Each grid 130 has a resilient concave portion 131 that gradually recesses from the edge towards the center, and a supporting convex portion 132 is formed between each adjacent two resilient concave portions 131. The bottom layer of the mat body 100 is woven using filament yarn, while the remaining parts are woven using staple fiber yarn.

The finishing operation includes:

cutting the woven mat into individual pieces, placing them in a high-temperature steam chamber, and steaming for a preset time to cause the mat dimensions to shrink and the thickness to increase, with the temperature controlled between 140° C. and 160° C.

The coating application operation includes:

applying an anti-slip coating to the finished mat's bottom surface, which is made from filament yarns, using a coating machine; and placing the coated mat into a drying oven for drying and curing.

The rapier loom herein refers to a weaving device that completes weft insertion through a reciprocating rapier weft insertion mechanism. The high-temperature steam chamber treatment refers to using a saturated steam environment for mat setting, which may be achieved using a pressure vessel combined with a steam injection system. Through the thermal and moisture effects, the overall dimensions of the mat shrink, and the yarn thickness expands and increases.

Specifically, in the weaving operation, filament yarns are configured for the bottom layer, their continuous fiber structures providing a stable base for coating. In the finishing operation, high-temperature steam treatment causes the staple fiber part to shrink, making the 3D structure of the resilient concave portion 131 and the supporting convex portion 132 more pronounced, while the filament yarns, due to high thermal stability, remain flat. In the coating operation, the smooth surface and tight fiber structure of the filament yarns provide a uniform adhesion interface for the coating, forming a firmly bonded anti-slip coating layer after drying and curing.

In the related art, existing waffle mats using staple fiber yarns as the base material suffer from poor coating adhesion due to loose fiber ends. As a comparison, the proposed solution of the present disclosure uses a filament yarn base combined with high-temperature setting, thereby creating a dense surface structure on the yarn. The mechanical interlock between the coating and the filament yarns is significantly enhanced, maintaining anti-slip performance after multiple washes. In addition, the steam shrinkage process increases mat thickness and improves the stability of the 3D structure of concave and convex portions, thereby enhancing the mat's performance.

Finally, it should be noted that the above embodiments are only intended to illustrate the technical solutions of the present disclosure and are not intended to limit them. Although the present disclosure has been described in detail with reference to the foregoing embodiments, those skilled in the art should understand that they may modify the technical solutions described in the various embodiments, or replace some of the technical features with equivalents. Such modifications or replacements do not cause the essence of the corresponding technical solutions to deviate from the spirit and scope of the technical solutions of the various embodiments of the present disclosure.

What is claimed is:

1. A waffle weave floor mat, comprising a mat body; wherein the mat body is formed by interweaving a plurality of knitted warp yarns and a plurality of knitted weft yarns lengthwise and crosswise; each of a top surface and a bottom surface of the mat body is divided into a plurality of grids; each of the plurality of grids comprises a resilient concave portion gradually recessed from an edge towards a center, and a supporting convex portion is formed between each adjacent two resilient concave portions;

the plurality of knitted warp yarns comprise bottom warp yarns located on the bottom surface of the mat body and main body warp yarns located in other positions; the plurality of knitted weft yarns comprise bottom weft yarns located on the bottom surface of the mat body and main body weft yarns located in other positions;

at least one kind of the bottom warp yarns and the bottom weft yarns is filament yarns; the main body warp yarns and the main body weft yarns are staple fiber yarns; and the bottom warp yarns and the bottom weft yarns are at least coated with an anti-slip coating on a side away from the top surface of the mat body.

2. The waffle weave floor mat according to claim 1, wherein the bottom warp yarns and the bottom weft yarns are both made of long fibers; a diameter of each of the bottom warp yarns is greater than a diameter of each of the main body warp yarns; and a diameter of each of the bottom weft yarns is greater than a diameter of each of the main body weft yarns.

3. The waffle weave floor mat according to claim 2, wherein at least one of the following is satisfied:

a ratio of the diameter of the bottom warp yarns to the diameter of the main body warp yarns is greater than 2, or a ratio of the diameter of the bottom weft yarns to the diameter of the main body weft yarns is greater than 2.

4. The waffle weave floor mat according to claim 2, wherein each of the bottom warp yarns is formed by twisting at least two strands of yarn together; and each of the bottom weft yarns is formed by twisting at least two other strands of yarn together.

5. The waffle weave floor mat according to claim 4, wherein a diameter of each strand of each of the bottom warp yarns is greater than or equal to the diameter of the main body warp yarns; and a diameter of each strand of each of the bottom weft yarns is greater than or equal to the diameter of the main body weft yarns.

6. The waffle weave floor mat according to claim 4, wherein a twist level of the at least two strands of each of the bottom warp yarns is less than a twist level of the main body warp yarns.

7. The waffle weave floor mat according to claim 6, wherein a twist level of each strand of each of the bottom warp yarns is less than the twist level of the main body warp yarns.

8. The waffle weave floor mat according to claim 4, wherein a twist level of the at least two other strands of each of the bottom weft yarns is less than a twist level of the main body weft yarns.

9. The waffle weave floor mat according to claim 8, wherein a twist level of each strand of each of the bottom weft yarns is less than the twist level of the main body weft yarns.

10. The waffle weave floor mat according to claim 5, wherein a twist level of the at least two strands of each of the bottom warp yarns is less than a twist level of the main body warp yarns; and a twist level of the at least two other strands of each of the bottom weft yarns is less than a twist level of the main body weft yarns.

11. The waffle weave floor mat according to claim 10, wherein a twist level of each strand of each of the bottom warp yarns is less than the twist level of the main body warp yarns; and a twist level of each strand of each of the bottom weft yarns is less than the twist level of the main body weft yarns.

12. The waffle weave floor mat according to claim 1, wherein both a warp float length and a weft float length of the mat body transition and increase gradually from a central bottom of the resilient concave portion towards peripheral edges, causing the warp float length and the weft float length on the top surface and the bottom surface of the mat body to be greater than the warp float length and the weft float length at other positions.

13. The waffle weave floor mat according to claim 1, wherein a material of the bottom warp yarns and the bottom weft yarns is filament polyester.

14. The waffle weave floor mat according to claim 1, wherein the main body warp yarns and the main body weft yarns are both formed by blending long fibers and short fibers.

15. The waffle weave floor mat according to claim 1, wherein the bottom warp yarns and the bottom weft yarns are made of hollow yarns.

16. The waffle weave floor mat according to claim 15, wherein a hollow ratio of each of the hollow yarns is greater than or equal to 15% and less than or equal to 40%.

* * * * *